US010946438B2

(12) United States Patent
Montgrain et al.

(10) Patent No.: US 10,946,438 B2
(45) Date of Patent: Mar. 16, 2021

(54) TUBULAR SHAPE CASTING APPARATUS

(71) Applicant: 8617490 Canada Inc., Saint-Bruno-de-Montarville (CA)

(72) Inventors: Luc Montgrain, Terre Haute, IN (US); Jean-François Desmeules, Jonquiere (CA); Olivier Dion-Martin, Laterrière (CA)

(73) Assignee: 8617490 Canada Inc., Saint-Bruno-de (CA)

( * ) Notice: Subject to any disclaimer, the term of this patent is extended or adjusted under 35 U.S.C. 154(b) by 8 days.

(21) Appl. No.: 16/492,538

(22) PCT Filed: Mar. 5, 2018

(86) PCT No.: PCT/CA2018/050257
§ 371 (c)(1),
(2) Date: Sep. 9, 2019

(87) PCT Pub. No.: WO2018/161156
PCT Pub. Date: Sep. 13, 2018

(65) Prior Publication Data

US 2020/0398334 A1 Dec. 24, 2020

Related U.S. Application Data

(60) Provisional application No. 62/469,880, filed on Mar. 10, 2017.

(51) Int. Cl.
*B22D 13/10* (2006.01)
*B22D 13/02* (2006.01)
*B22D 25/02* (2006.01)

(52) U.S. Cl.
CPC ..... *B22D 13/101* (2013.01); *B22D 13/023* (2013.01); *B22D 13/107* (2013.01); *B22D 13/108* (2013.01); *B22D 25/02* (2013.01)

(58) Field of Classification Search
CPC ..... B22D 13/00; B22D 13/02; B22D 13/023; B22D 13/10; B22D 13/101; B22D 13/102; B22D 13/107; B22D 13/108
See application file for complete search history.

(56) References Cited

U.S. PATENT DOCUMENTS 2,747,244 A 5/1956 Goss
2,752,648 A 7/1956 Robert
(Continued)

FOREIGN PATENT DOCUMENTS

CN 100999013 7/2007
FR 2180494 7/1997
(Continued)

OTHER PUBLICATIONS

Luc Montgrain et al., Continuous Centrifugal Casting: A Revolutionary Process for Casting Aluminium 1 24 Tubes, Light Metals 2018, The Minerals, Metals & Materials Series © The—Minerals, Metals & Materials Society 2018, edited by Olivier Martin Jan. 31, 2018—Technology & Engineering—1637 pages (pp. 815-822).
(Continued)

*Primary Examiner* — Kevin P Kerns
*Assistant Examiner* — Steven S Ha
(74) *Attorney, Agent, or Firm* — Benoit & Cote, Inc.; C. Marc Benoit

(57) ABSTRACT

A system for casting a length of a pole of a tubular shape with molten metal. The system comprises a crucible for containing the molten metal; a pouring spout fluidly connected to the crucible; and a plunger for plunging in the crucible to increase level of the molten metal in the crucible and thereby forcing a flow of the molten metal from the crucible to the pouring spout. The system further comprises a casting ring for receiving the molten metal poured out of the pouring spout; a motor for rotating the casting ring; a
(Continued)

cooling assembly for cooling the molten metal; and a pulling assembly for pulling the pole out of and away from the casting ring as the molten metal solidifies.

20 Claims, 5 Drawing Sheets

(56) References Cited

U.S. PATENT DOCUMENTS

| | | | |
|---|---|---|---|
| 3,430,684 | A | 3/1969 | Babel et al. |
| 3,702,630 | A | 11/1972 | Peytavin |
| 3,771,587 | A | 11/1973 | Poran |
| 3,776,295 | A | 12/1973 | Mola |
| 3,781,158 | A | 12/1973 | Leghorn |
| 3,844,333 | A | 10/1974 | Peytavin |
| 8,567,155 | B2 | 10/2013 | Waugh |
| 2008/0142184 | A1 | 6/2008 | Li et al. |

FOREIGN PATENT DOCUMENTS

| | | |
|---|---|---|
| GB | 817847 | 8/1959 |
| GB | 827262 | 2/1960 |
| GB | 1342054 | 12/1973 |

OTHER PUBLICATIONS

Luc Montgrain et al. Development of a Prototype Unit fbr Continuous Centrifugal Casting of 1-24 Aluminium Tubes, Light Metals 2018, The Minerals, Metals & Materials Series © The Minerals, Metals & Materials Society 2018, edited by Olivier Martin Jan. 31, 2018—Technology & Engineering—1637 pages (pp. 823-835).

TUBULAR SHAPE CASTING APPARATUS

CROSS-REFERENCE TO RELATED APPLICATION

This application claims priority from U.S. patent provisional application 62/469,880 filed Mar. 10, 2017, the specification of which is hereby incorporated herein by reference in its entirety.

BACKGROUND

(a) Field

The subject matter disclosed generally relates to metal casting. More particularly, the subject matter disclosed relates to the casting of shaped elements and more particularly tubular shapes elements such as electric light poles.

(b) Related Prior Art

In the field of metal tubular shape fabrication, the standard method of fabrication consists in the extrusion of a preheated ingot of solid material with an important pressure with a mold to shape the material into the desired tubular shape. This method requires some steps and tools that may be avoided using a new process.

There is therefore a need for a new system for manufacturing shaped elements such as tubular shape elements that is more efficient.

SUMMARY

According to an embodiment, there is disclosed a system for casting a pole having a tubular shape by pouring molten metal, the system comprising: a casting ring for receiving the molten metal; a motor for rotating the casting ring; and a pulling assembly for pulling the pole out of and away from the casting ring as the molten metal solidifies.

According to an aspect, the system further comprises a cooling assembly for cooling the molten metal upon being poured on the casting ring.

According to an aspect, the casting ring comprises a chamber, an inflow port fluidly connected to the chamber, and wherein the cooling assembly feeds cooling fluid to the chamber through the inflow port to cool down the casting ring.

According to an aspect, the system further comprises an upstream ring, wherein the casting ring contacts the upstream ring upstream from the pole, and wherein the upstream ring prevents the molten metal from travelling further upstream.

According to an aspect, the upstream ring comprises a surface comprising a material which is refractory to the molten metal.

According to an aspect, the system further comprises a downstream ring downstream from the upstream ring and comprising an internal face facing an inner surface of the casting ring, wherein the pole is pulled downstream between the casting ring and the downstream ring.

According to an aspect, the internal face of the downstream ring forms a conic shape whereby a space between the casting ring and the downstream ring is greater downstream than upstream.

According to an aspect, the internal face of the downstream ring comprises a porous material, and wherein the system further comprises a lubricating assembly for feeding lubricant to the porous material and onto an inner surface of the pole.

According to an aspect, the downstream ring comprises a face comprising a material which is refractory to the molten metal.

According to an aspect, the cooling assembly comprises ports directed toward an external surface of the pole, wherein the ports are fed with a cooling fluid to produce cooling jets directed to the external surface.

According to an aspect, the ports are distributed around the pole.

According to an aspect, the cooling assembly comprises ports directed toward the external surface of the pole distant and downstream from the casting ring, wherein the ports are fed with a cooling fluid to produce cooling jets directed toward the external surface.

According to an aspect, the pole has an axis and wherein the pulling assembly comprises a support assembly comprising wheels contacting the external surface of the pole.

According to an aspect, the wheels of the support assembly are driven by the pole.

According to an aspect, the pulling assembly comprises wheels engaged with the external surface of the pole, the wheels being oriented at an angle between a) parallel to the axis of the pole and b) perpendicular to the axis of the pole.

According to an aspect, the system further comprises a first motor rotating the casting ring at a first speed, and a second motor driving the wheels engaged with the pole to rotate the pole at a second speed, wherein the first motor and the second motor are operating such that the first speed is equal to the second speed.

According to an aspect, the pulling assembly comprises a plurality of sub-assemblies distributed at different distances downstream from the casting ring.

According to an aspect, the system further comprises: a crucible for containing the molten metal; a pouring spout fluidly connected to the crucible; and a plunger for plunging in the crucible to increase level of the molten metal in the crucible and thereby forcing a flow of the molten metal from the crucible to the pouring spout and onto the casting ring.

According to an aspect, the system further comprises an overflow canal, wherein the overflow canal provides fluid guidance for the molten metal between the crucible and the pouring spout.

According to an aspect, the casting ring comprises an inner surface of a cylindrical shape, the inner surface comprising a material which is refractory to the molten metal.

According to an embodiment, there is provided a method for casting a pole of a tubular shape having a length and an external surface with molten metal, the method comprising: pouring the molten metal over a casting ring having an inner diameter, the casting ring being mounted to a motor operable to rotate the casting ring at a rotating speed; cooling the casting ring, whereby the molten metal contacting the casting ring gradually solidifies; and pulling gradually the pole out of the casting ring while rotating the pole at the rotating speed, wherein the rotating of the casting ring and the pulling of the pole increases gradually the length of the pole.

According to an aspect, the method further comprises cooling the pole using cooling jets oriented toward the external surface of the pole.

According to an aspect, the step of pulling the pole comprises the steps of: contacting the external surface of the pole with a first set of wheels driven by the pole at a first distance from the poured molten metal; and engaging the pole with a second set of wheels driven by a motor at a second distance from the poured molten metal, wherein the second set of wheels pulls the pole downstream while rotating the pole at the rotating speed.

According to an aspect, wherein the step of pouring comprises: limiting dispersion of the molten metal over the casting ring upstream with an upstream ring abutting the casting ring; and limiting dispersion of the molten metal over the casting ring downstream with a downstream ring inward relatively to the casting ring.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
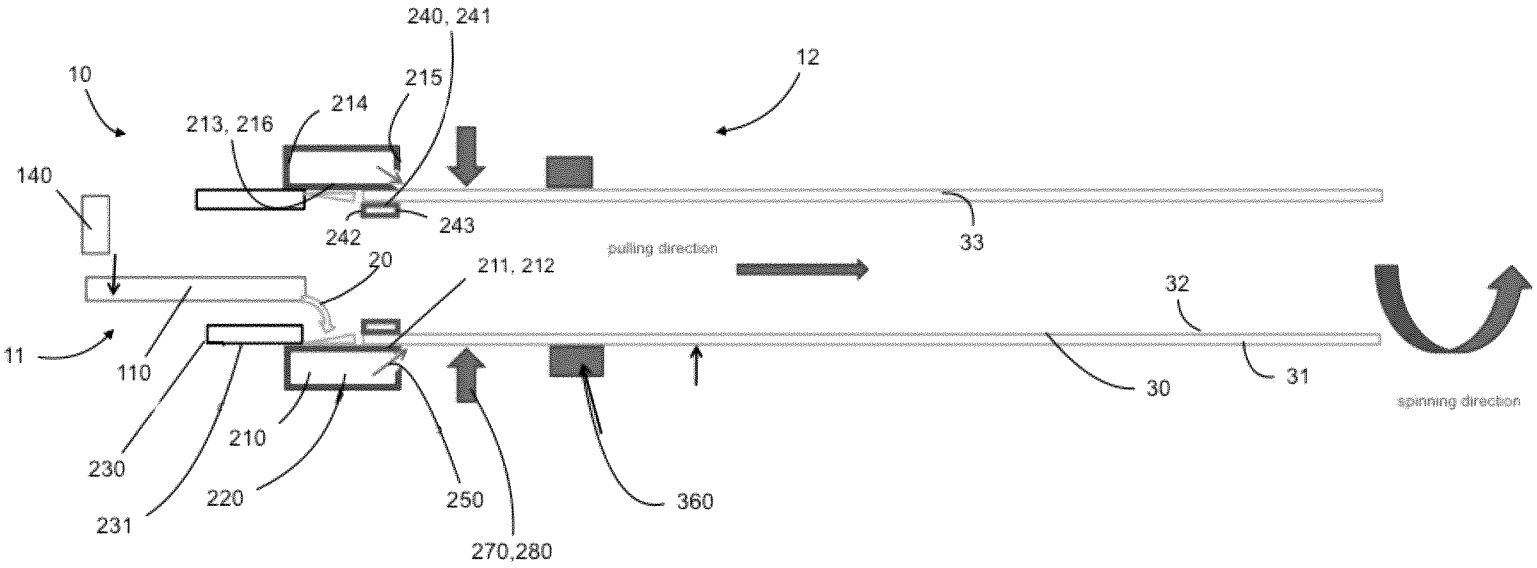
FIG. 1 is a side elevation view of a system for casting shaped elements having a tubular shape, the cast element being cast in accordance with an embodiment.
Figure 1A:
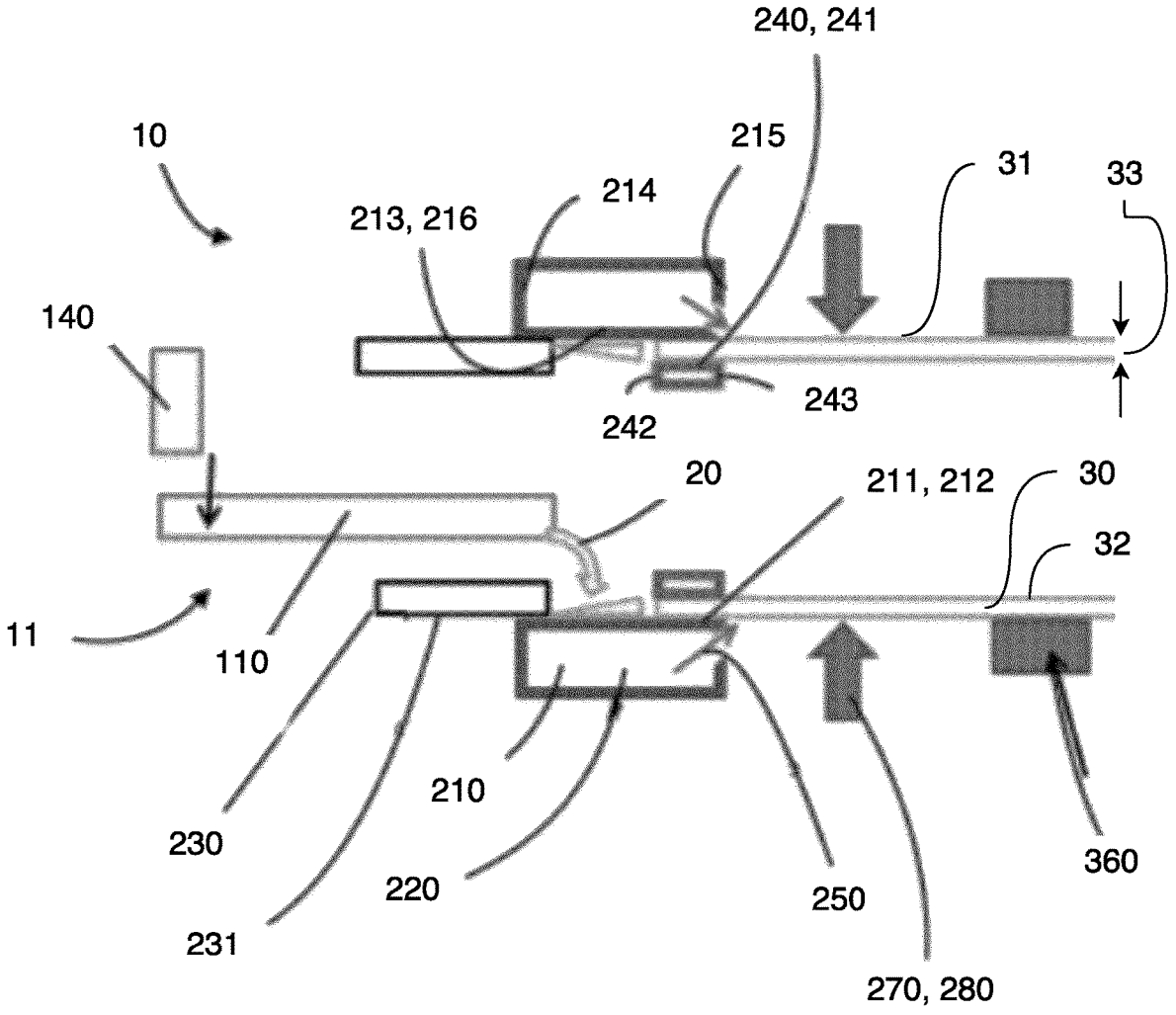
Figure 2:
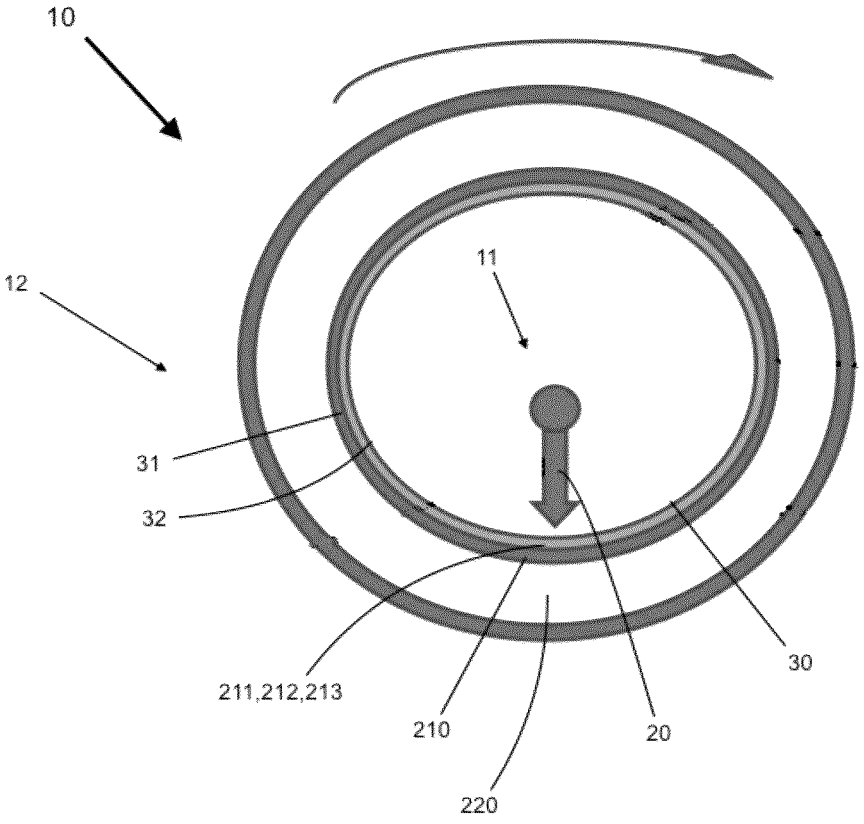
FIG. 2 is a front sectional view of the system of FIG. 1.

Referring now to the drawings, and more particularly to FIGS. 1 and 2, there is shown a casting system 10 for casting a tubular shape element 30 (e.g., a pole), and more specifically a metal tubular shape element 30. The casting of a tubular shape element 30 comprises pouring molten metal 20, which is, according to an embodiment, aluminum alloy of the type AA 6063, into a casting sub-system 12. The molten metal 20 is poured in a casting area over a casting surface with the cast being in a rotary movement so that the poured molten metal 20 moves away from the casting area freeing it for new molten metal 20 to be poured. The tubular shape element 30 is also pulled out continuously from and by the casting sub-system 12. The tubular shape element 30 is thus casted with new material being added according to a screw-type motion.

In order to obtain a high-quality tubular shape element 30, the process requires a precisely controlled process comprising precisely controlling the amount of molten metal 20 to be poured at any moment during the casting process, such as precisely controlling the revolution speed and the pulling speed applied on the tubular shape element 30. The result is a tubular shape element 30 having metal quality and thickness that are constant over its circumference and its length.

For description purposes, a general direction is defined for use herein, the direction being from the pouring area (upstream) toward the pulling area (downstream). Accordingly, hereinafter when referring to a "upstream component", the specification refers to the component on the left of FIG. 1, and when referring to a "downstream component", the specification refers to the component on the right of FIG. 1. Similarly, components will have an upstream end (left end) and a downstream end (right end). Finally, a downstream direction refers to a left-to-right direction according to FIG. 1.

The casting system 10 comprises a feeding sub-system 11 and the casting sub-system 12. The feeding sub-system 11 comprises components involved in melting the metal and feeding the molten metal 20 to the casting sub-system 12. The casting sub-system 12 comprises components involved in pouring the molten metal 20 in a casting area to form, or more precisely to increase the length of the tubular shape element 30 in addition to the components for handling the tubular shape element 30. The tubular shape element 30 casted accordingly has an external surface 31, an inner surface 32, and a thickness 33.

The feeding sub-system 11 comprises an oven (not shown) used to melt metal, typically aluminum alloy of the type AA 6063, by elevating and by maintaining the temperature of different components in preparation and along the casting process. It further comprises a crucible 110 in which metal is melt and in which the molten metal 20 is kept during the casting process, an overflow canal 120 connected at one of its end to the crucible 110, and at its other end to a pouring spout 130 provides fluid guidance to the flow of molten metal 20. It further comprises the pouring spout 130. It also comprises a plunger 140 made of a refractory material. The plunger 140 is attached about its head to a plunging mechanism 150 (see FIG. 6) controlling the diving speed and depth of the plunger 140 in the crucible 110. Thus, the plunging mechanism 150 controls the amount of molten metal 20 displaced by the plunger 140 such as the rate of displacement of molten metal 20 in the crucible 110. The level of molten metal 20, rises during the casting process, resulting in molten metal 20 travelling from the crucible 110 to the overflow canal 120 (see FIGS. 6, 7 and 8) and to the pouring spout 130. More precisely, when the level of the molten metal 20 rises to the level of the overflow canal 120, the molten metal 20 reaching the level of the overflow canal 120 pours into the overflow canal 120 and travels by gravity to the casting sub-system 12.

Figure 6:
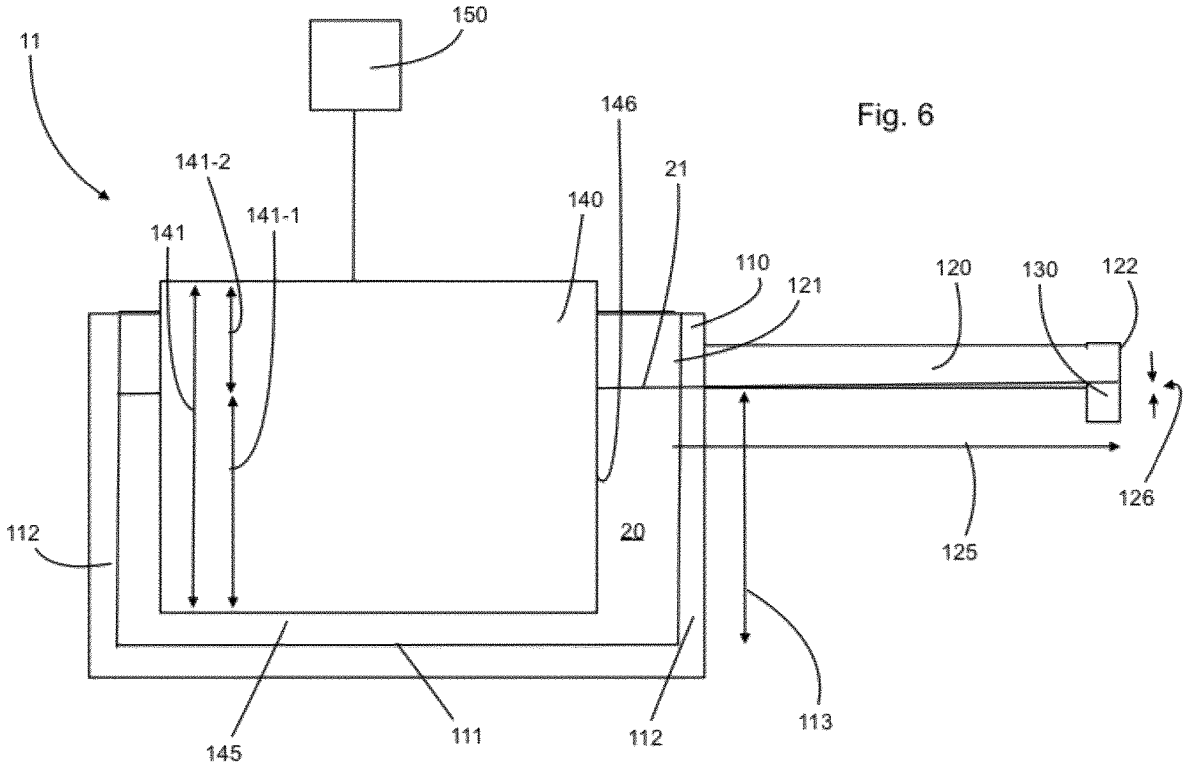
FIG. 6 is a schematic sectional side elevation view of a feeding system according to an embodiment.
Figure 7:
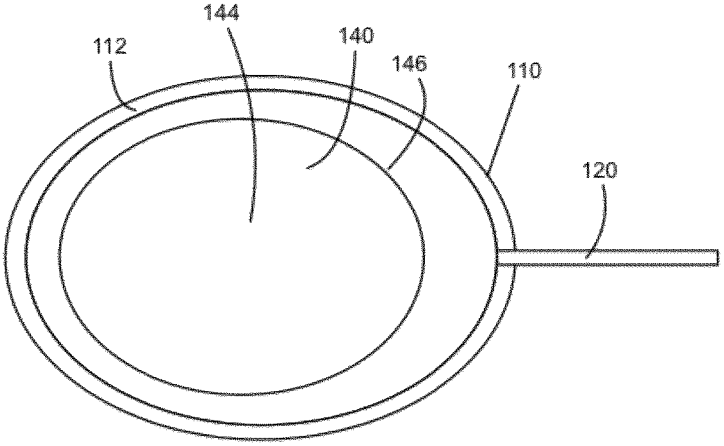
FIG. 7 is a schematic top view of a feeding system according to an embodiment.

Referring now more specifically to the plunger 140 of FIG. 1 and additionally to FIGS. 6 and 7. The plunger 140 as a height 141, comprising a plunging height 141-1 and a handling height 141-2 above the plunging height 141-1, and a displacement area 144 according to a plane parallel to the surface 21 of the molten metal 20. According to an embodiment, the displacement area 144 of the plunger 140 is constant over the whole plunging height 141-1 of the plunger 140. Accordingly, a constant descent of the plunger 140 in the crucible 110 when the crucible 110 contains molten metal 20 results in a constant displacement rate of the molten metal 20, i.e. a constant flow of molten metal 20 travelling from the crucible 110 to the overflow canal 120. With the molten metal 20 that enters in the overflow canal 120 travelling to the pouring spout 130 and pouring over the casting surface, a precise control of the flow of molten metal 20 for casting the tubular shape element 30 is thereby achieved.

According to an embodiment, the plunger 140 consists in a hollow component having an exterior surface impermeable to the molten metal 20. The hollow characteristic of the plunger 140 minimizes its weight.

According to an embodiment, the plunger 140 is made of refractory material to minimize the interactions of the plunger 140 with the molten metal 20.

Referring now more specifically to the crucible 110 of FIG. 1 and additionally to FIGS. 6 and 7. According to an embodiment, the crucible 110 defines a containing surface comprising a floor 111 and one or more walls 112 having a height 113 and together defining a volume limited by the containing surface for containing molten metal 20. The height 113 is defined from the floor 111, or lowest point of the crucible to the height of the overflow canal 120 located on one wall 112.

Referring now particularly to FIGS. 1, 6 and 7 for the operation of the plunger 140 in the crucible 110. The plunger 140 is adapted to operate from a first position, with the bottom 145 of the plunger 140 slightly under the surface 21 of the molten metal 20 contained in the crucible 110, wherein a known (and typically constant) displacement area 144 of the plunger 140 interferes with the surface 21 of the molten metal 20, to a second position, still having the same constant displacement area 144 interfering with the surface of the molten metal 20, where the bottom 145 of the plunger 140 is close to the floor 111 of the crucible 110. The distance between the bottom 145 of the plunger 140 and the floor 111 of the crucible 110 is typically about one inch (1 inch).

According to an embodiment, the plunger 140 has a cylindrical shape. The plunger 140 has a diameter that is smaller than the distance between any opposed walls 112 of the crucible 110, or of the inner diameter of a crucible 110 of a cylindrical shape. In other words, the crucible 110 is able to house the plunger 140 according to its displacement area 144 along its plunging height 141-1. According to an embodiment, the plunger 140 and the crucible 110 are cylindrical and are disposed co-axially. According to another embodiment, the plunger 140 and the crucible 110 are not disposed co-axially. According to any embodiment, the system prevents any contact of the external surface 146 or of the bottom 145 of the plunger 140 with the containing surface (the floor 111 and the walls 112) of the crucible 110. According to an embodiment, an operating distance of about one and a half inch (1.5 inch) is defined between the external surface 146 of the plunger 140 and the overflow canal 120; this distance is for preventing surface tension of molten metal 20 to influence the flow of molten metal 20 into the overflow canal 120.

According to embodiments, the rate of molten metal 20 that flows from the crucible 110 to the overflow canal 120 as the plunger 140 descends into the crucible 110 is set between three (3) kg of molten metal 20 to twenty (20) kg of molten metal 20 per minute.

Figure 8:
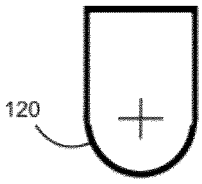
FIG. 8 is a schematic sectional view of an overflow canal according to an embodiment.

Referring now more specifically to FIGS. 6, 7 and 8 for the overflow canal 120. According to an embodiment, the overflow canal 120 consists in a substantially semi-cylindrical canal of about three quarters of an inch (0.75 inch) in diameter. The overflow canal 120 is secured in a semi-permanent fashion (allowing to secure and dismount the overflow canal 120) to a wall 112 of the crucible 110 at its inflow end 121 and comprises or is secured to a pouring spout 130 at its outflow end 122. The overflow canal 120 has a depth of about 2 inches, with the portion of the wall 112 of the overflow canal 120 rising above the center of curvature of its cylindrical portion extending substantially vertically. The overflow canal 120 has a length 125 between the inflow end 121 and the outflow end 122 of about thirty (30) inches with a pitch 126 of about a quarter of an inch (0.25 inch) over the length 125 of the overflow canal 120. The outflow end 122 of the overflow canal 120, connected to the pouring spout 130, being the lowest of the two ends 121, 122. The length 125 of the overflow canal 120 connects the crucible 110, located in a controlled temperature environment, to the casting sub-system 12, outside the controlled temperature environment.

According to an embodiment, the overflow canal 120 is made of a refractory material. That refractory material according to an embodiment consists of N14™ board from Pyrotek or any similar refractory board.

According to an embodiment, either the crucible 110, the plunger 140, the overflow canal 120 and the pouring spout 130, or any combination of these components are processed with a non-wetting coating, such as a coating of boron nitride, for the coated component(s) to better resist to molten metal sticking thereto.

According to an embodiment, the oven, and the crucible 110 located in the oven during the casting process, are mounted on driven rails (not shown) disposed in a longitudinal orientation similar to the longitudinal orientation of the tubular shape element 30. By driving the oven on the rails towards and backwards with respect to the casting sub-system 12, a fine control of the casting area in which molten metal 20 is poured is realized.

Now referring to the casting sub-system 12 in light of FIGS. 1 to 5 and particularly FIGS. 1 and 2. The casting sub-system 12 comprises a casting ring 210 comprising an inner diameter 216 and an inner surface 213. The casting ring 210 defines a casting surface 211 (located on the inner surface 213 of the casting ring 210) with each segment of the casting surface 211 periodically performing the function of the casting area 212 in which the molten metal 20 is poured, and where it solidified while contacting the casting surface 211. The casting ring 210 is driven in a rotary motion at a constant rotating speed by a motor 217. The casting ring 210 further comprises an enclosed water chamber 220 having an inflow port (not shown) and an outflow port (not shown) through which water (a.k.a. cooling fluid) flows to cool down the casting ring 210 during the casting process. The casting ring 210 has an upstream end 214 and a downstream end 215. The direction defined along the longitudinal orientation of the tubular shape element 30 from the upstream end 214 to the downstream end 215 corresponds to the pulling direction of the casted tubular shape element 30.

According to an embodiment, the casting ring 210 is made of aluminum.

According to an embodiment, the inner surface 213 of the casting ring 210, comprising the casting surface 211, is coated with a non-sticking coating. According to embodiment, the coating consists of graphite or boron nitride.

The casting sub-system 12 further comprises an upstream ring 230, made of refractory material, or in other words featuring refractory characteristics relative to the molten metal 20, located at the upstream end 214 of the casting ring 210. The upstream ring 230 has an outer diameter 231 substantially matching the inner diameter 216 of the casting ring 210 to abut the inner surface 213 of the casting ring 210. The upstream ring 230 is thus preventing molten metal 20 from flowing upstream and exiting the casting sub-system through the upstream end 214 of the casting ring 210.

According to another embodiment, the upstream ring 230 is replaced with an upstream component matching the shape of the casting surface 211 about the casting area 212, and extending about a portion of the circumference of the casting ring 210. According to that alternative embodiment, the upstream component is not rotating with the casting ring 210. According to an embodiment, the upstream component is vibrating to improve flow of molten metal 20 poured on the casting ring 210 and to decrease adhesion of molten metal 20 on the upstream component. The upstream component is located about the casting area 212 where the molten metal 20 is poured onto the casting surface 211.

According to an embodiment, the upstream ring 230 is coated with a non-sticking coating. According to an embodiment, the coating consists of boron nitride.

According to an embodiment, the material in which is made the upstream ring 230 is selected for allowing a preheating process to have the upstream ring 230 at a predetermined temperature before the initiation of the casting process for preventing premature solidification of the molten metal 20 when contacting the upstream ring 230.

The casting sub-system 12 further comprises a downstream ring 240 for ensuring a minimum thickness 33 of solidified metal for the tubular shape element 30 before that portion of the tubular shape element 30 leaves that portion of the casting sub-system 12. The downstream ring 240 is located about the downstream end 215 of the casting ring 210. The downstream ring 240 is made of a porous material. According to an embodiment, the downstream ring 240 is fed with oil (a.k.a. lubricant) by a lubricating assembly (not shown) for coating the external surface 31 of the tubular shape element 30 with said oil thereby easing the handling of the tubular shape element 30 by different components afterwards and thus preventing the solidifying tubular shape element 30 from tearing as the tubular shape element 30 is pulled. The downstream ring 240 has a slightly conic shaped face 241 (i.e., an internal face) (not visible on FIG. 1) facing the inner surface 213 of the casting ring 210 whereby a space between the casting ring 210 and the downstream ring 240 is greater downstream than upstream. The downstream ring 240 has a larger upstream diameter 242 (located farther from the upstream end 214 of the casting ring 210) than its downstream diameter 243 (located closer to the upstream end 214 of the casting ring 210). The slightly conic shaped face of the downstream ring 240 is for preventing the tubular shape element 30 from sticking in the downstream ring 240. According to an embodiment, a face (the upstream face) of the downstream ring 240 features refractory characteristics relative to molten metal 20.

The casting ring 210, the upstream ring 230 and the downstream ring 240 are rotating during the casting process. The rotation of the rings 210, 230, 240 are for a plurality of functions, comprising continuously freeing casting area 212 for the pouring of new molten metal 20 in the casting area 212, ensuring a constant thickness 33 of the tubular shape element 30, and ensuring a good contact between the external surface 31 of the tubular shape element 30 and one or more of the rings 210, 230, 240.

According to an embodiment, the revolution speed of one or more of the rings 210, 230, 240 is selected to result in a centrifugal force exceeding the gravitational force. Accordingly, not fully solidified molten metal 20 is pushed towards the casting ring 210, even at the top of the casting ring 210. According to an embodiment, the revolution speed is selected to apply a centrifugal force of about one and a half times (1.5×) the gravitational force. According to another embodiment, the revolution speed is selected below a pre-set limit based on the rate of pouring of molten metal 20, to ensure a stable and precise pouring process.

The casting sub-system 12 further comprises a cooling assembly for rapidly and controllably cooling down a to-be-cooled surface, e.g., the cast tubular shape element 30, in order to be able to handle the tubular shape element 30, comprising forcing a revolution of the tubular shape element 30 by gradually pulling the tubular shape element 30 at a constant speed out of the casting ring 210. The cooling assembly comprises a series of cooling sub-assemblies disposed from an upstream portion to the casting ring 210 and downstream thereof.

Figure 3:
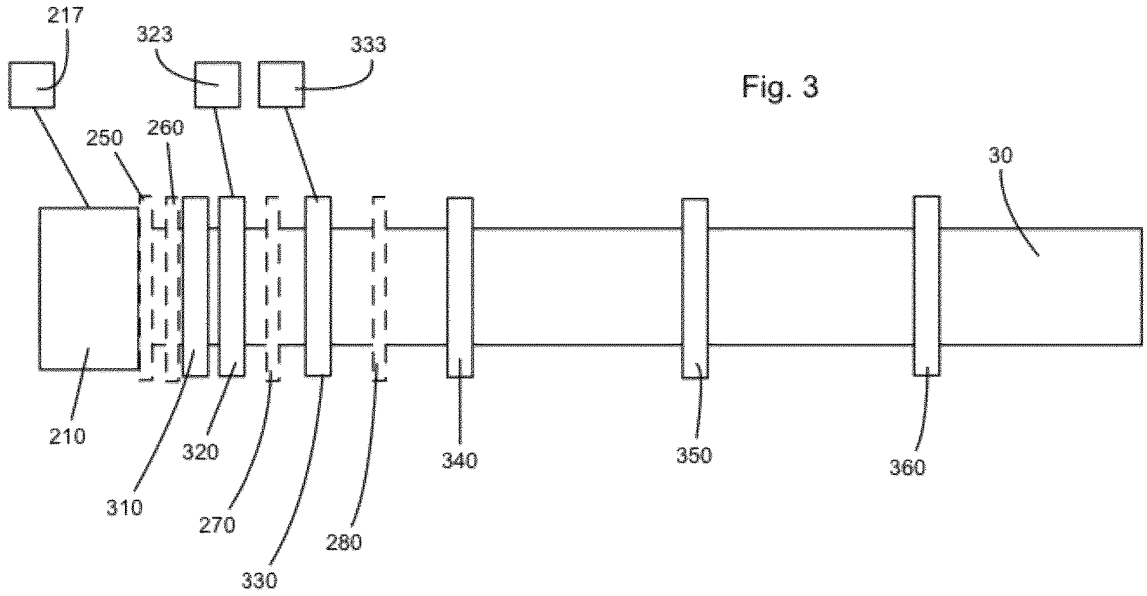
FIG. 3 is a schematic side elevation view the system of FIG. 1.
Figure 5:
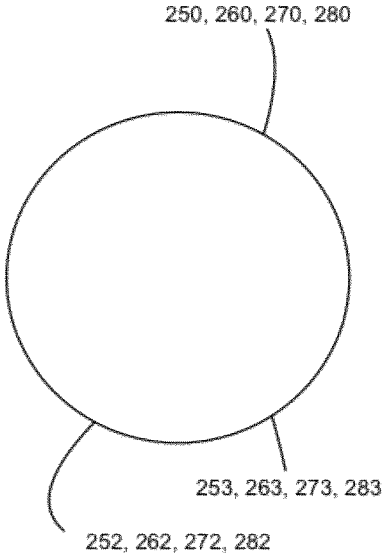
FIG. 5 is a schematic view of a cooling sub-system according to an embodiment.

Referring now particularly to FIGS. 3 and 5, the cooling assembly comprises a first cooling sub-assembly 250, located downstream with respect of the casting ring 210 about its downstream end 215. The first cooling sub-assembly 250 comprises a series of ports 252, typically sixteen according to an embodiment, from which streams 253 (or cooling jets) of water are directed toward the external surface 31 of the tubular shape element 30. According to an embodiment, the water streams 253 are planar broom-shaped streams oriented transversally of the casting orientation distributed around the tubular shape element 30, so that the streams 253 contact a segment of the circumference of the tubular shape element 30. The streams 253 are oriented inwardly toward the tubular shape element 30 and slightly downstream, typical about 30 degrees away from the pouring of the molten metal 20, to prevent the water projected by any of the streams (including further downstream streams) from flowing upstream once deflected by the external surface 31 of the tubular shape element 30.

According to an embodiment, the cooling assembly further comprises a second cooling sub-assembly 260 located downstream relatively to the first cooling sub-assembly 250. The second cooling sub-assembly comprises a series of ports 262, typically sixteen, providing a series of streams 263, typically sixteen, oriented toward the casting ring 210.

According to an embodiment, the cooling assembly further comprises a third cooling sub-assembly 270 and a fourth cooling sub-assembly 280. The third cooling sub-assembly 270 and a fourth cooling sub-assembly 280, located downstream relatively to the second cooling sub-assemblies 260, each comprise a series of ports 272, 282, typically sixteen each, providing a series of streams 273, 283, typically sixteen, oriented toward the casting ring 210 in a longitudinal orientation with respect to the orientation of the tubular shape element 30.

It is to be noted that the number of cooling sub-assemblies may vary according to embodiments, based on material characteristics, operation parameter, and casting dimensions. The above number of cooling sub-assemblies is an exemplary embodiment in relation with the described realization.

According to an embodiment, the temperature of the water is kept between about six (6) degrees Celsius and forty (40) degrees Celsius; which is the water temperature in a normal temperature variation over a year without heating or cooling the water. According to an embodiment, the water temperature varies between about six (6) degrees Celsius and eighteen (18) degrees Celsius. The difference between the temperature of the cooling water and the temperature of the molten metal 20 renders such a variation of temperature of the cooling water negligible and thereby does not affect the quality of the tubular shape element 30.

According to an embodiment, the pressure of cooling water for cooling the tubular shape element 30 is kept between about thirty (30) PSI (pounds per square inch) and seventy (70) PSI. According to an embodiment, the pressure is maintained between about forty (40) PSI and sixty (60) PSI.

According to an embodiment, the locations of the third cooling sub-assembly 270 and a fourth cooling sub-assembly 280 is further selected to have the streams 273, 283 touching distinct segments of the external surface 31 of the tubular shape element 30 of about ten (10) inches in diameter. The tubular shape element 30 which form the resulting cast pole therefore has a substantially constant diameter.

Figure 4:
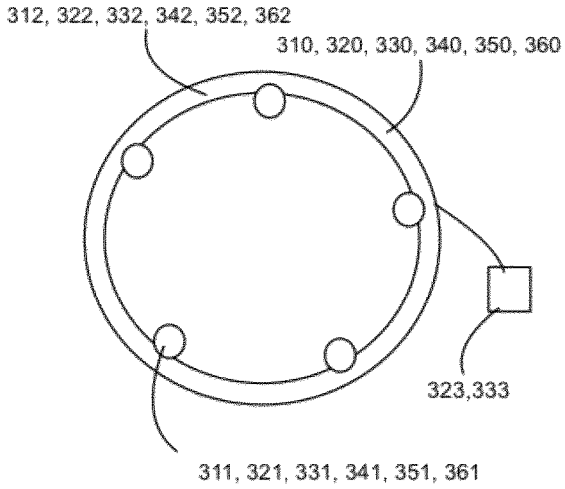
FIG. 4 is a schematic front view of a pulling-sub-assembly according to an embodiment.

Referring now particularly to FIGS. 3 and 4, the casting sub-system 12 further comprises a pulling assembly for pulling the tubular shape element 30 out of the casting ring 210. According to an embodiment, the pulling assembly comprises a series of six pulling sub-assemblies referred from first to sixth from a foremost upstream position toward a downstream position. It is to be noted that the number of pulling sub-assemblies may vary according to embodiments, based on material characteristics, operation parameter, and casting dimensions. The use of six pulling sub-assemblies is an exemplary embodiment in relation with the described realization.

The pulling assembly comprises a first pulling sub-assembly 310, a.k.a. a support sub-assembly as explained hereinafter, comprising a set of five wheels 311 mounted to a circular structure 312. The wheels 311 are distributed around the tubular shape element 30 close to the downstream end 215 of the casting ring 210. The wheels 311 are in contact with the external surface 31 of the tubular shape element 30 while permitting longitudinal movement and revolution of the tubular shape element 30. The first pulling sub-assembly 310 comprises free-spinning wheels 311 (not motorized), allowing free movement of the tubular shape element 30 within the limits defined by the set of wheels 311.

According to an embodiment, the wheels 311 of the first pulling sub-assembly 310 are made of a material resistant to a temperature of about one hundred and fifty (150) degrees Celsius. One such material is a rubber-based material resisting to such temperature.

The pulling assembly comprises a second pulling sub-assembly 320 comprising a set of wheels 321 (typically five) that are driven by a motor 323. The set of wheels 321 are engaged with the external surface 31 forcing a revolution of the tubular shape element 30 synchronized with the revolution movement of the casting ring 210. The set of wheels 321 are applying a contact pressure on the external surface 31 of the tubular shape element 30 ensuring that there is no slipping between the wheels 321 and the external surface 31 of the tubular shape element 30. The wheels 321 are oriented about an angle between a) parallel to the axis of the pole and b) perpendicular to the axis of the pole, thus adapted to force revolution and axis displacement of the tubular shape element 30. The wheels 321 are further driven by the motor 323 to perform a revolution and pulling operations on the tubular shape element 30. As the first pulling sub-assembly 310, the second pulling sub-assembly 320 comprises a structure 322 shaped as a ring holding the components of the pulling sub-assembly 320 together. According to an embodiment, the structure 322 rotates at the same speed as the casting ring 210.

The pulling assembly comprises a third pulling sub-assembly 330 comprising a set of wheels 331 (typically five) that are mounted on a structure 332 and that are driven by a motor 333. The sets of driven wheels 331 are responsible to perform the pulling operation, in collaboration with the second pulling sub-assembly 320, over the tubular shape element 30.

The pulling assembly comprises a fourth pulling sub-assembly 340 located farther downstream. The fourth pulling sub-assembly 340 is a support sub-assembly for preventing undesired movement, or flexion, of the tubular shape element 30 out its axis. According to an embodiment, the fourth pulling sub-assembly 340 is similar to the first pulling sub-assembly 310, more specifically in the number of wheels 341, the structure 342 housing the wheels 341, and the sub-assembly 340 being not motorized and thus the tubular shape element 30 driving the wheels 341.

The pulling assembly comprises a fifth pulling sub-assembly 350 and a sixth pulling sub-assembly 360 each comprising a set of non-motorized low-friction wheels 351, 361, mounted on a structure 352, 362, for holding and guiding the extremity of the tubular shape element 30 that is distant from the casting ring.

One must note that the initiation of the casting process involves inserting an initial tubular shape element (not shown) in the casting ring 210 through at least the second pulling sub-assembly 320 and first pulling sub-assembly 310. The use of an initial tubular shape element provides the solid component allowing to perform revolution and pulling of the cast tubular shape element 30 through its provided solid external surface 31.

One must also note that the casting process may be performed in a continuous manner, with the process comprising cutting in place a length of the cast tubular shape element 30 when the cast tubular shape reaches a predetermined length. The remaining portion of the cast tubular shape element 30 is then used to continue the casting process, being available to be pulled for continuing pulling newly cast portions of the cast tubular shape element 30.

According to an embodiment, the speed at which the tubular shape element 30 is pulled out of the casting ring 210 is selected for the tubular shape element 30 to be of a defined thickness 33. A higher pulling speed would either decrease the thickness 33 of the tubular shape element 30 or would require a greater flow of molten metal 20, since increasing the probabilities of the still hot portion of the tubular shape element 30 breaking in view of the centrifugal force applied to the rotary motion. A lower pulling speed has the opposite effect that allowing the tubular shape element 30 to cool down outside the casting ring increases the probabilities of molten metal 20 pouring out of the casting ring 210 at its upstream end 214. According to an embodiment, the selected pulling speed is between about six (6) inches per minute and ten (10) inches per minute.

According to an embodiment, a pre-casting process is performed before the beginning of the casting of the tubular shape element 30. The pre-casting process comprises heating the metal to be used to cast the tubular shape element 30 to obtain the molten metal 20. The process comprises the pre-heating of components involved in the tubular shape casting process, such as the plunger 140, the overflow canal 120, the pouring spout 130 and one or more rings 210, 230, 240. The duration of the pre-heating process depends on the thermal inertia of the components. The thermal inertia of components depends on their composition and physical configuration (e.g., thickness). The pre-casting process comprises the preparation of the molten metal 20, comprising the heating and melting, the mixing, sampling and analysing of the molten metal 20, the "fluxing" with for example, some magnesium chloride ($MgCl_2$), the maintenance of low hydrogen level in the molten metal 20 to obtain a high quality result with low porosity level, the cleaning of the surface of molten metal 20 with a skimmer to remove undesired impurities, the isolation or degassing of the molten metal with an inert gas (e.g., argon), etc.

The pre-casting process may involve alternative steps, which may not include some of the above listed steps based on the desired quality of the tubular shape element, the nature of the metal used for casting tubular shape elements, the details of the different components involved in the casting process, as some parameters set for performing the casting, such as the rotatory speed and the pulling speed. One must construe that these steps are interdependent and that the present embodiments are described according to particular design selections, and do not aim to limit the scope of the disclosure.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A system for casting a pole having a tubular shape by pouring molten metal, the system comprising:

a casting ring for receiving the molten metal, the casting ring comprising an inner surface;

a downstream ring downstream from where the casting ring receives the molten metal, the downstream ring comprising an internal face facing the inner surface of the casting ring with the internal face of the downstream ring forming a conic shape whereby a space between the casting ring and the downstream ring is greater downstream than upstream;

a motor for rotating the casting ring; and a pulling assembly for pulling the pole out of and away from the casting ring as the molten metal solidifies.

2. The system of claim 1, further comprising a cooling assembly for cooling the molten metal upon being poured on the casting ring.

3. The system of claim 2, wherein the casting ring comprises a chamber, an inflow port fluidly connected to the chamber, and wherein the cooling assembly feeds cooling fluid to the chamber through the inflow port to cool down the casting ring.

4. The system of claim 2, wherein the cooling assembly comprises ports directed toward an external surface of the pole, wherein the ports are fed with a cooling fluid to produce cooling jets directed to the external surface.

5. The system of claim 4, wherein the cooling assembly comprises ports directed toward the external surface of the pole distant and downstream from the casting ring, wherein the ports are fed with a cooling fluid to produce cooling jets directed toward the external surface.

6. The system of claim 4, wherein the pole has an axis and wherein the pulling assembly comprises a support assembly comprising wheels contacting the external surface of the pole.

7. The system of claim 6, wherein the wheels of the support assembly are driven by the pole.

8. The system of claim 7, wherein the pulling assembly comprises wheels engaged with the external surface of the pole, the wheels being oriented at an angle between a) parallel to the axis of the pole and b) perpendicular to the axis of the pole.

9. The system of claim 8, further comprising a first motor rotating the casting ring at a first speed, and a second motor driving the wheels engaged with the pole to rotate the pole at a second speed, wherein the first motor and the second motor are operating such that the first speed is equal to the second speed.

10. The system of claim 1, further comprising an upstream ring, wherein the casting ring contacts the upstream ring upstream from the pole, and wherein the upstream ring prevents the molten metal from travelling further upstream.

11. The system of claim 10, wherein the upstream ring comprises a surface comprising a material which is refractory to the molten metal.

12. The system of claim 11, wherein the downstream ring is downstream from the upstream ring, wherein the pole is pulled downstream between the casting ring and the downstream ring.

13. The system of claim 1, wherein the internal face of the downstream ring comprises a porous material, and wherein the system further comprises a lubricating assembly for feeding lubricant to the porous material and onto an inner surface of the pole.

14. The system of claim 1, wherein the downstream ring comprises a face comprising a material which is refractory to the molten metal.

15. The system of claim 1, further comprising:

a crucible for containing the molten metal;

a pouring spout fluidly connected to the crucible; and a plunger for plunging in the crucible to increase level of the molten metal in the crucible and thereby forcing a flow of the molten metal from the crucible to the pouring spout and onto the casting ring.

16. The system of claim 1, wherein the casting ring comprises an inner surface of a cylindrical shape, the inner surface comprising a material which is refractory to the molten metal.

17. A method for casting a pole of a tubular shape having a length and an external surface with molten metal, the method comprising:

pouring the molten metal over a casting ring having an inner diameter defining an inner surface, the casting ring being mounted to a motor operable to rotate the casting ring at a rotating speed, and the casting ring facing a downstream ring located downstream from where the casting ring receives the molten metal, the downstream ring comprising an internal face facing the inner surface of the casting ring with the internal face of the downstream ring forming a conic shape whereby a space between the casting ring and the downstream ring is greater downstream than upstream;

cooling the casting ring, whereby the molten metal contacting the casting ring gradually solidifies; and pulling gradually the pole out of the casting ring while rotating the pole at the rotating speed, wherein the rotating of the casting ring and the pulling of the pole increases gradually the length of the pole.

18. The method of casting a pole of claim 17, further comprising cooling the pole using cooling jets oriented toward the external surface of the pole.

19. The method of casting a pole of claim 17, wherein the step of pulling the pole comprises the steps of:

contacting the external surface of the pole with a first set of wheels driven by the pole at a first distance from the poured molten metal; and engaging the pole with a second set of wheels driven by a motor at a second distance from the poured molten metal, wherein the second set of wheels pulls the pole downstream while rotating the pole at the rotating speed.

20. The method of casting a pole of claim 17, wherein the step of pouring comprises:

limiting dispersion of the molten metal over the casting ring upstream with an upstream ring abutting the casting ring; and limiting dispersion of the molten metal over the casting ring downstream with a downstream ring inward relatively to the casting ring.

* * * * *